US005500956A

United States Patent [19]

Schulkin et al.

[11] Patent Number: 5,500,956

[45] Date of Patent: Mar. 26, 1996

[54] BASKETBALL GLOVE

[76] Inventors: William V. Schulkin, 56 Iselin Terr., Larchmont, N.Y. 10538; Mark C. Mirken, 235 E. 40th St., New York, N.Y. 10016

[21] Appl. No.: 275,545

[22] Filed: Jul. 15, 1994

[51] Int. Cl.[6] ..... A41D 19/00; A63B 71/00

[52] U.S. Cl. ..... 2/161.1; 2/161.3; 2/159; 273/1.5 A; 434/248

[58] Field of Search ..... 2/161.1, 161.3, 2/161.8, 159, 161.5; 273/1.5 A; 434/248

[56] References Cited

U.S. PATENT DOCUMENTS

| | | | |
|---|---|---|---|
| Re. 22,167 | 8/1942 | Wells | 2/159 |
| 425,887 | 4/1890 | Kohler | D29/115.4 R |
| 1,954,262 | 4/1934 | Potter | 2/159 |
| 2,092,318 | 9/1937 | Lindfelt | 2/159 |
| 2,309,710 | 2/1943 | Patterson | D29/113.4 R |
| 2,465,136 | 3/1947 | Troccoli | 2/159 |
| 2,702,906 | 4/1952 | Causse | 2/159 |
| 2,751,598 | 6/1954 | Romeo | 2/161 |
| 2,928,102 | 10/1958 | Canausa | 2/161 |
| 2,980,915 | 4/1961 | Peterson | 2/159 |
| 3,404,409 | 10/1968 | Tillotson et al. | 2/161.8 |
| 3,501,773 | 3/1970 | Stansberry | 273/1.5 A X |
| 3,597,765 | 8/1971 | Stanton | 2/159 |
| 3,649,967 | 3/1972 | Millman | 2/161 A |
| 3,707,730 | 1/1973 | Slider | 273/1.5 A X |
| 3,871,029 | 3/1975 | Hollman | 2/161.1 |
| 4,095,292 | 6/1978 | Klein | 2/161.1 X |
| 4,183,100 | 1/1980 | De Marco | 2/168 X |
| 4,224,692 | 9/1980 | Sundberg | 2/161 R |
| 4,420,843 | 12/1983 | Genzling et al. | 2/161.1 |
| 4,497,072 | 2/1985 | Watanabe | 2/161.1 X |
| 4,589,146 | 5/1986 | Taylor | 2/161 A |
| 4,738,447 | 4/1988 | Brown | 273/1.5 A |
| 4,747,163 | 5/1988 | Dzierson | 2/161.1 |
| 4,881,276 | 11/1989 | Swan | 2/161 A |
| 4,947,486 | 8/1990 | Hsiuh | 2/159.4 R |
| 5,164,231 | 11/1992 | Davis | 2/161.3 X |
| 5,316,294 | 5/1994 | Turangan | 2/161.1 X |

FOREIGN PATENT DOCUMENTS

| | | | |
|---|---|---|---|
| 2430092 | 1/1976 | Germany . | |
| 2536180 | 2/1977 | Germany | 2/161.1 |
| 2721409 | 11/1978 | Germany . | |
| 2840197 | 3/1980 | Germany | 2/161.1 |
| 2843448 | 4/1980 | Germany | 2/161.1 |
| 148604 | 6/1980 | Germany . | |

OTHER PUBLICATIONS

Basketball, Building The Complete Program Stewart & Scholz, Walworth Pub. Co. pp. 24–54 & p. 93.

Franklin Sports, Inc.—Cecil Fielder Digital Leather Baseball Glove—Stoughton, MA.

HOOPS? The Official National Basketball Players Assen Guide to Playing Basketball, Gandolfi & Couzens 1987 Mc–Graw Hill Paperbacks, pp. 45–66 & 79–120.

Riegel Textile Corp. Mews Wear Jun. 19, 1953 p. 50.

Cabela'a Spring 1992 catalog.

*Primary Examiner*—John J. Calvert

*Attorney, Agent, or Firm*—Kuhn and Muller

[57] ABSTRACT

An athletic glove especially adapted for handling a basketball includes a palm layer and a top layer sewn together at their lateral edges to provide a substantially partially thumbless, fingertipless, wristless, four fingered glove body construction having the outer surface of the palm layer being covered by a plurality of rubberized protruding friction elements having a hemispherical shape substantially the same size and shape as protruding elements upon the surface of a basketball. The palm layer and the top layer are made of a spandex type material adapted to stretch and closely conform to the anatomy of the hand of a wearer of the basketball glove. The glove resists rotation and reversal of direction of a moving basketball approaching and contacting the hand of a basketball player. The glove also dampens impact, so that the basketball has less of a tendency to jump out of the hands of a player during a fast moving basketball game.

2 Claims, 3 Drawing Sheets

BASKETBALL GLOVE

FIELD OF THE INVENTION

The present invention relates to a glove for basketball players wherein the fingertips are exposed and the palm of the hand is covered with a stippled fabric surface to engage the stippled surface of a basketball, and thereby resist or arrest rotation of the ball, to facilitate a better grip when catching, holding, dribbling or shooting the basketball.

BACKGROUND OF THE INVENTION

Specialized gloves for athletes have been designed to enhance their performance in certain events as well as to provide a degree of comfort and safety in connection with their athletic endeavors. For example, golfers having long used a variety of gloves for enhancing the gripping of golf clubs; baseball players recently adopted special baseball gloves for enhancing their gripping of baseball bats; bowlers have had gloves for use in connection with bowling heavy balls; archers have utilized gloves to enhance the gripping of bows and arrows; basketball players have had bulky "training gloves"; and bicyclists have utilized gloves to shock absorbtion during the gripping of handlebars.

Representative of the state of the athletic glove art are U.S. Pat. Nos. 4,881,276 of Swan; 4,738,447 of Brown; 4,589,146 of Taylor; 3,707,730 of Slider; 3,649,967 of Millman; 3,597,765 of Stanton; 3,404,409 of Tillorson, 2,928,102 of Canausa; 2,751,598 of Romeo; 2,702,906 of Causse; 2,465,136 of Triccoli; 2,092,318 of Lindfelt and 1,954,262 of Potter; together with German Federal Republic Pat. Nos. 24 30 092 and 27 21 409. Other non-athletic gloves include U.S. Pat. Nos. 4,224,692 of Sundberg and U.S. Pat. No. Re. 22,167 of Wells, as well as German Democratic Republic Patent Number 148604.

Moreover, it is known that it is preferable that a basketball be in contact with certain site-specific portions of the hand. On page 36 of *Basketball Skills and Drills*, by Jerry Kramer, Leisure Press, Copyright 1991, it is taught that the basketball should touch the insides of the fingers from the tips to the palm, as well as the raised portions of the palm below the fingers and below the thumb. *Hoops*! , by Giorgio Gandolfi and Gerald Secor Couzen, McGraw-Hill Book Company, 1987, also teaches at page 93 that the fingers and the raised portions of the palm should touch the basketball. Moreover, it is also taught in Norm Stewart, *Basketball Building the Complete Program*, Walworth Publishing Co., 1980 at page 33 that the fingers control the basketball, but the top part of the hand can touch the basketball.

Furthermore, it is known that the finger tips and thumb need to be exposed to the surface of the basketball to maximize tactile feel when shooting, throwing, passing or catching the ball. When catching the ball, the sweat on the skin of the palm of the hand causes the thrown or rebounded basketball to continue to rotate upon touching the hand and to tend to compress and reverse direction away from the hand of the person catching or rebounding the basketball.

Therefore, there is a longfelt need in the sport of basketball to provide a glove which exposes the essential fingertips and upper knuckle portions of the fingers and thumb, while providing a rotation and bounce resistant surface on the remaining portions of the hand which should contact the basketball, namely, the upper portions of the palm, and the portions of the palm below the thumb and extending down the side of the palm below the pinky little finger.

The prior art patents do not address this longfelt need. For example, Potter '262 and German patent no. 24 30 092 each have an angled bottom which teaches away from the present invention by exposing the portions of the palm below the thumb. Brown '447 has a heavy weight on the back of the glove.

Lindfelt '318 and Troccoli '136 restrict the wrist and Troccoli '136 also exposes the palm below the thumb. Causse '906, Stanton '765, Sundberg '692, Taylor '146, Swan '276, Wells '167, Tillorson '409, Canausa '102 and German patent no. 27 21 409 completely cover the fingertips. German patent no. 148604 is a bandage with an insulating foam to protect the palm from machine vibrations.

Moreover, Romeo '598 contains restraining strips which artificially restrain the movement of the thumb and last two fingers. Millman '967 restricts the wrist with fastener portions, and covers most of the thumb.

Therefore none of the prior art gloves strategically expose the upper portions of the fingers and thumb, while covering the palm portions below the fingers at the top of the palm, as well as the portions of the palm below the thumb and pinky little finger, with a material having rounded protrusions which interact with corresponding rounded protrusions on the cover of a basketball, to resist or arrest the rotation and reversal of direction of a basketball when it contacts a hand.

Heretofore, there have been no specialized constructions of gloves to aid basketball players in actual game or practice conditions in their game in connection with shooting and handling a basketball. It is to a new and improved athletic glove, specially designed for basketball players for use in actual practice and game competition that the present invention is directed. Specifically, the preferred embodiment of the glove comprises an abbreviated substantially "thumbless" and "tipless" four-finger glove body which slips over the palm and fingers of the user, leaving the thumb, the tips and knuckles of each of the four fingers exposed. The preferred embodiment is essentially a "palm glove" and is wristless and essentially fingerless except for a minor thumb portion and for a minor portion of the four fingers below the knuckles.

More specifically, the new glove is made from an ultra lightweight stretchable, moisture-absorbing elastic material, most advantageously ("Lycra") spandex which conforms faithfully to the anatomy of the hand of the user and further includes a pattern of miniaturized rubber-like (PVC) friction dots (hemispheres) or protruding cones disposed over the entire palm of the glove to provide a ball gripping and ball controlling surface.

These protruding portions resist or arrest the rotation and reversal of direction of the basketball upon contacting a hand, dampening impact of the ball. The protrusions absorb energy of impact, and they mesh with corresponding protrusions on the surface of a basketball. As a result the ball does not jump out of the user's hands.

In accordance with the principles of the invention the new glove provides concentrated support to the central hand and palm portions while greatly enhancing gripping, controlling, and shooting abilities for a basketball being handled by the wearer of the glove. The new glove provides an extraordinary gripping surface to the wearer of the glove (it being understood that some players may opt to wear only a single glove if they shoot and pass predominantly with one hand although the benefits of the glove are derived more fully when both hands are covered by the gripping surfaces provided by the new glove).

The exposure of substantially the entire thumb, the four fingertips and the knuckles of the four fingers, in combination with the rubberized gripping elements provides the wearer with extraordinary shooting and passing "feel ", while the ultra lightweight and skin-tight fit effectively eliminates the sensation of being encumbered by a glove.

For a better appreciation of the structure and functioning of the basketball glove of the present invention and for a better appreciation of other of the attendant advantages of the invention, reference should be made to the following drawings taken in conjunction with the accompanying detailed description of the invention.

DETAILED DESCRIPTION OF THE INVENTION

Figure 1:
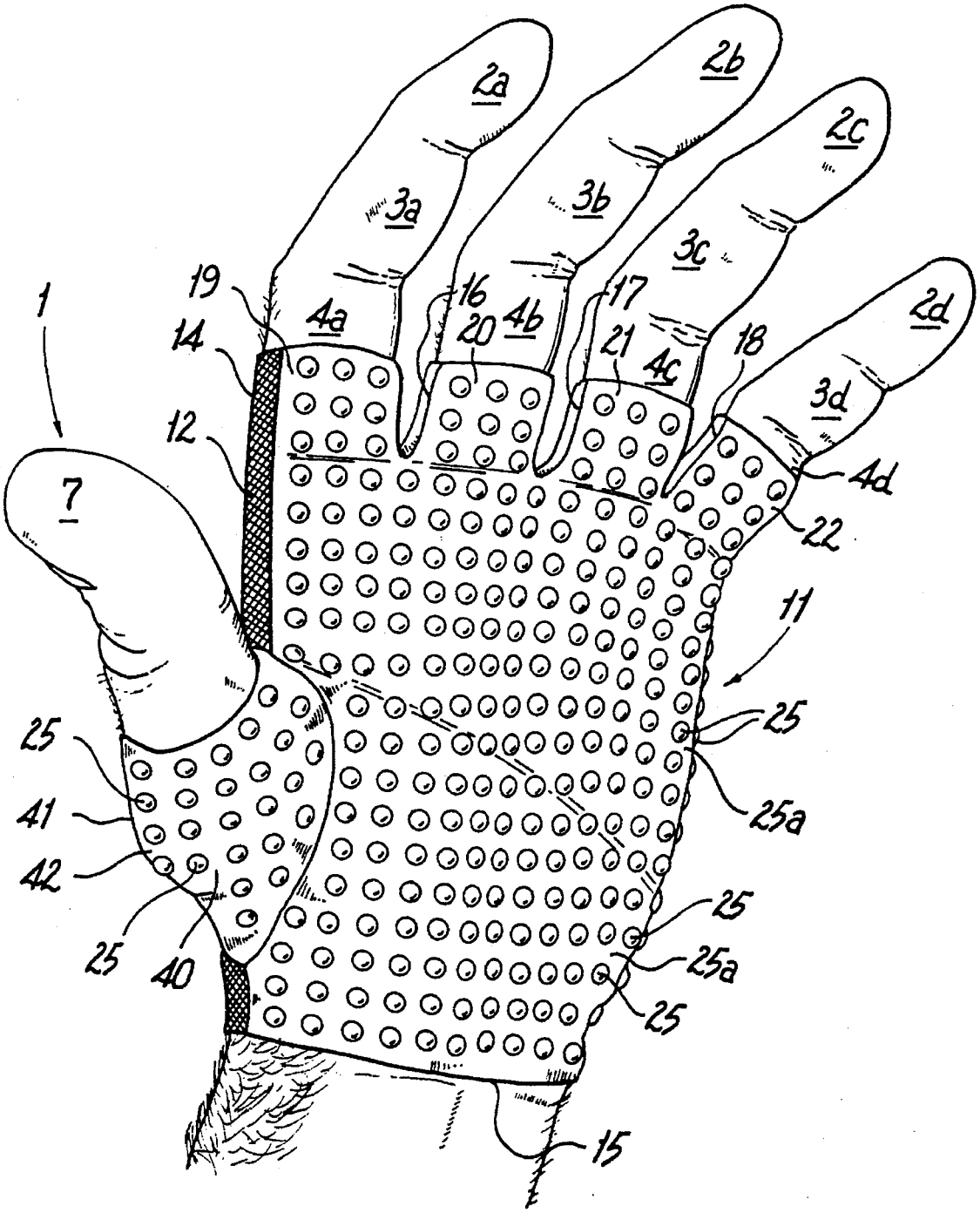
FIG. 1 is a perspective view showing the palm surface of the new glove (left handed)
Figure 1A:
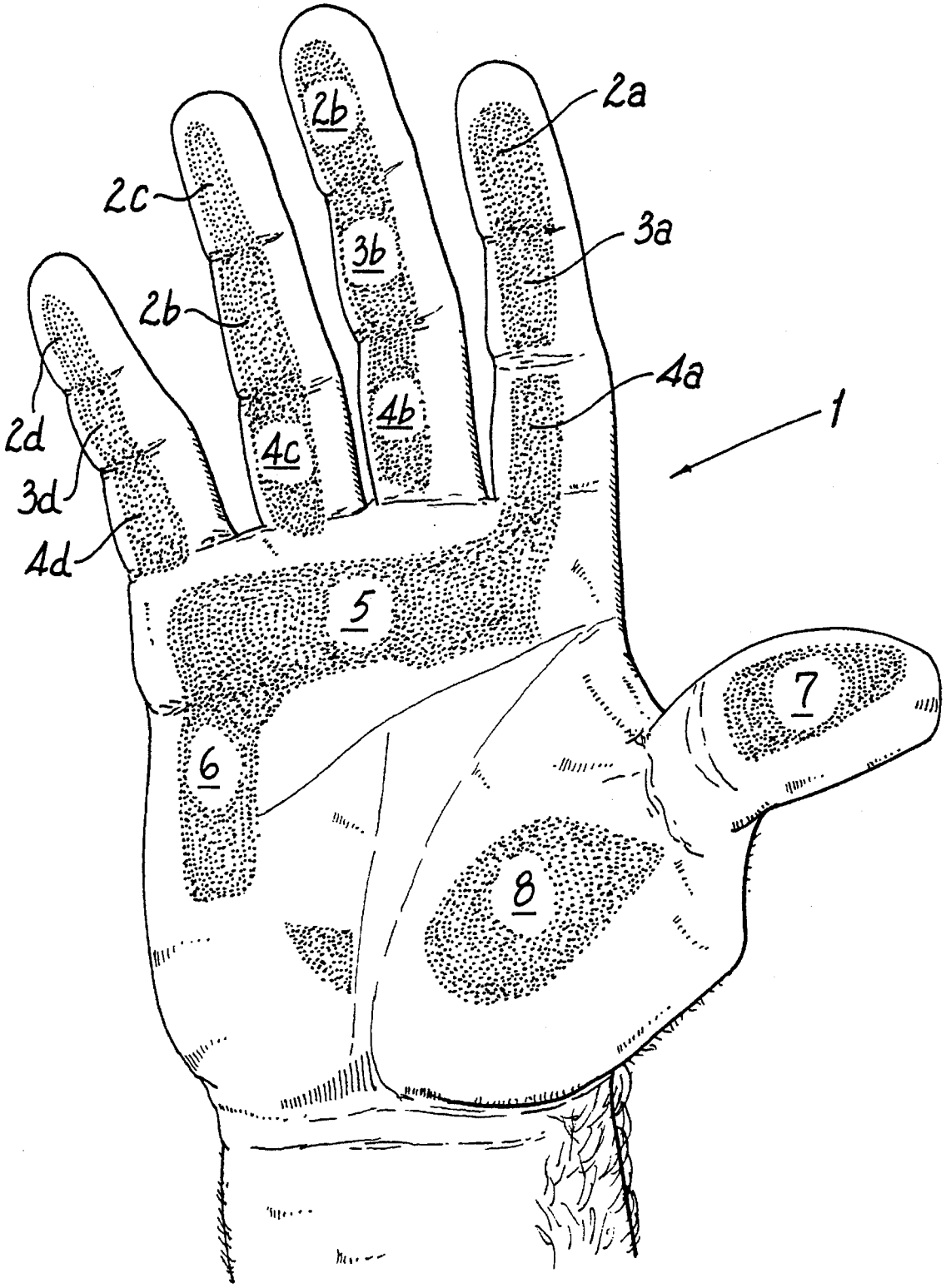
FIG. 1A is a prior art diagram of strategic portions of a hand.

Referring now to FIG. 1A, in a prior art diagram of a hand 1 of a basketball player, as shown in Kramer, supra, the parts of a hand which should contact a basketball include front fingertip portions 2*a*, 2*b*, 2*c* and 2*d*, as well as the portions 3*a*, 3*b*, 3*c* and 3*d* between the first and second knuckles and portions 4*a*, 4*b*, 4*c* and 4*d* below the second knuckles. In addition, the basketball should contact the horizontally extending upper pad portion 5 of the palm, as well as the vertically extending portion 6 below the pinky little finger. Finally, the basketball should contact the front tip 7 of the thumb and the fleshy pad portion 8 of the palm below the thumb.

Moreover, as shown in FIG. 1, to maximize fingertip exposure to the basketball, glove 10 exposes all of finger portions 2*a*, 3*a*, 2*b*, 3*b*, 2*c*, 3*c* and 2*d*, 3*d* above the second knuckle, as well as most of lower finger portions 4*a*, 4*b*, 4*c* and 4*d* below the second knuckle and above the base joints-of the fingers where the fingers join the palm of a hand. Glove 10 also strategically exposes thumb tip 7 and most of the thumb above fleshy pad portion 8 of the palm of hand 1.

Glove 10 may be characterized as a "wristless", substantially "thumbless", and "fingerless" glove body having a unique shape and palm and inner finger treatment to make it ideally suited to enhance the performance of basketball players.

Figure 2:
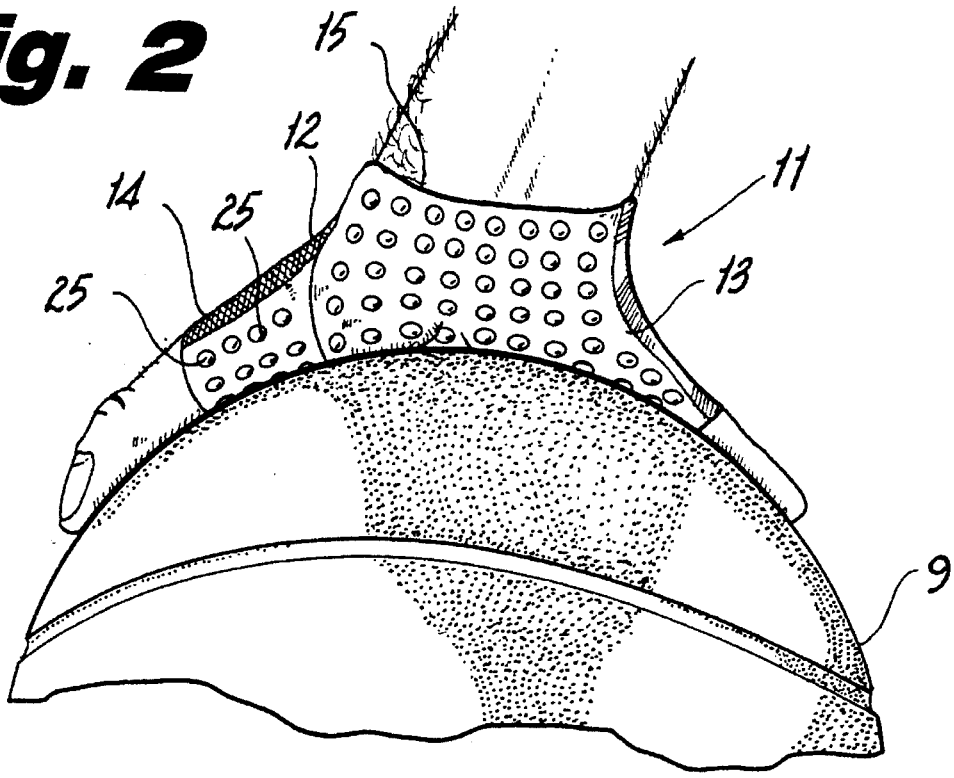
FIG. 2 is a rear perspective view showing the top surface of the glove of FIG. 1 in contact with a basketball; and, FIG. 3 is a close up cross sectional elevational view showing the details of construction of the new glove of FIG. 1 in contact with the protrusions upon a surface of a basketball.
Figure 3:
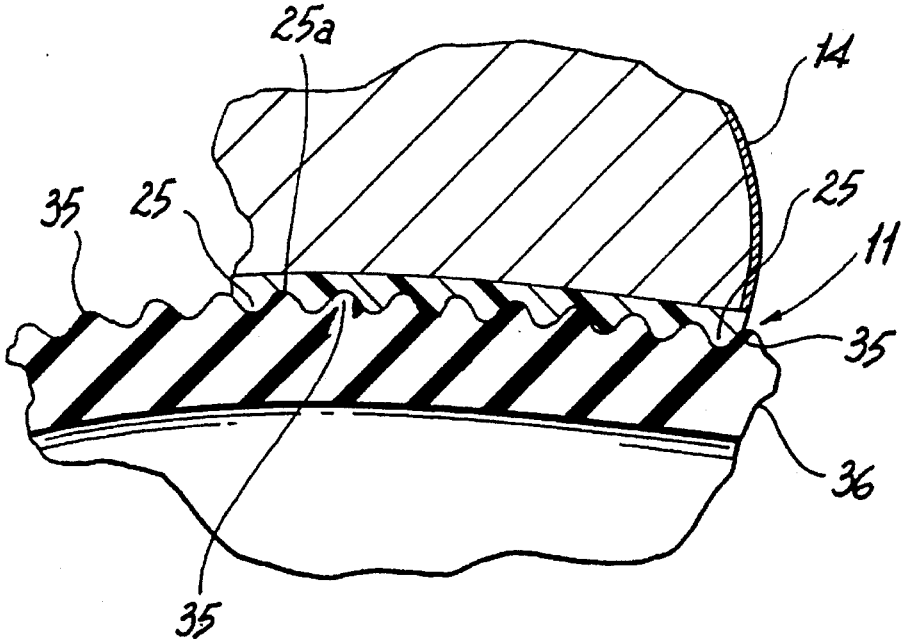

As shown in FIGS. 1 and 2 the glove body is comprised of a palm side panel element 11 sewn along lateral sides by stitches 12, 13 to a top side panel element 14. Both of the palm panel 11 and the top panel 14 are made from an absorbent stretchable spandex or other lightweight elastic material, which conforms faithfully in a skin-tight manner to the contours of the underlying hand portions sheathed by the glove.

The bottom perimeter 15 of glove 10 is adapted to encircle the hand just below the palm without encumbering wrist as shown in FIGS. 1 and 2. The upper portions of the palm and top sides 11, 14 are configured and sewn by lines of stitching 16, 17 and 18 to define partial finger tubes, 19, 20, 21 and 22 which are generally flattened when glove 10 is off the wearer and which tightly sheath the lower portions of the part of finger portions 4*a*, 4*b*, 4*c* and 4*d* below the second knuckles when glove 10 is worn, covering a small portion of the lower portions 4*a*, 4*b*, 4*c* and 4*d* of the index finger, middle finger, ring finger and pinky below the second lowermost knuckle joint of each.

In accordance with the principles of the invention, to provide a rotation resistant and impact dampening portion on the parts 5, 6 and 8 of the palm of the hand which contact basketball 9, the entire outer surface of the palm side 11 is cover with flexible tacky miniature rubber-like or PVC (polyvinylchloride) hemispherical protruding beaded elements 25 in a regular geometric pattern.

To resist rotation of the basketball 9 contacting hand 1 of the user and to dampen its impact, protruding beaded elements 25 are designed to correspond to protruding beaded elements 35 upon the surface 36 of basketball 9, so that basketball protruding beaded elements 35 are caught momentarily within valleys 25*a* between adjacent glove protruding beaded elements 25 extending up from glove portion 11. The meshing of pebbling protruding beaded elements 25 prevents basketball 9 from jumping out of the user's hand and reversing direction as in an uncaught or dropped basketball, and the material of the glove absorbs sweat to also enhance gripping of basketball 9.

Furthermore, the present invention is not a static gripping glove for holding golf clubs or baseball bats securely without release from the hand, but rather is a glove to enhance the random and erratic "on and off" encountering of moving basketball 9 with hand 1, in the facets of passing, catching, shooting, dribbling or rebounding basketball 9. This is achieved by exposing the fingertips and upper portions of the fingers and thumb, yet covering the portions of the palm with raised friction protruding beaded elements 25 to engage raised protruding elements 35 of basketball 9. Protruding beaded elements 25 transiently intercept and contact basketball protruding elements 35, thus assuring both quick gripping and quick release of the basketball 9 from hand 1.

Covering the palm surface portions 5, 6 and 8 with a transient adhering surface including protruding beaded elements 25 enables the player to better grip and catch basketball 9.

The new glove 10 is perspiration absorbent and therefore tends to keep the hand 1 of the player user dry; more importantly, it provides a friction gripping surface by virtue of the rubberized gripping protruding beaded elements 25 improving and facilitating handling and shooting of a basketball by the wearer of the new glove.

Moreover the rubberized protruding beaded elements 25 are disposed on both the front 40 and back 41 portions of the thumb, separated by seam 42, as indicated in FIG. 1. This has been found to be extremely advantageous, in view of the importance of the thumb and the degree of rotation that the thumb possesses in contradistinction with the remaining four fingers. Thus, it will be appreciated that gripping along the palm by the hand 1 is ensured by the array of rubberized protruding beaded elements 25 as shown.

The glove of the present invention is manufactured from stretchable spandex material ("Lycra"), which is ultra lightweight and conforms faithfully to the specific anatomy of the hand in skin-tight fashion. It is moisture absorbent and provides extraordinary anchoring for the rubberized protruding beaded elements 25 when they are properly and permanently adhered thereto by suitable production techniques. For example, the rubberized protruding beaded elements 25 may be applied in a predetermined pattern through a screen or otherwise deposited on the spandex while in the molten state and permitted to cure in situ to permanently bond to the interstices of the spandex material. Alternatively, the dots may be disposed in a predetermined matrix coated with a suitable adhesive and juxtaposed with the spandex material in a manner permitting permanent adhesively secured connection of the rubberized dots to the spandex material. It is a most important aspect of the invention that the rubberized protruding friction beaded elements 25 be permanently and positively adhered to the spandex so as not to delaminate or otherwise separate during the intended use of the glove.

Ultra light gloves manufactured in accordance with the foregoing specification fit in an essentially skin tight and extraordinarily comfortable manner to the wearer providing the wearer with little to no feeling that a glove is actually being worn. Thus, there is no hampering of the freedom or flexion of the joints and movement of the individual fingers during use, so that the actual ability of the hand to handle a basketball is greatly enhanced. Shooting, passing, and skills of pass receiving of the wearer of the glove are sharpened greatly by its employment during actual basketball competition.

While the foregoing description of the new and improved basketball glove has been given by way of illustration of the preferred embodiment of the invention, it is to be understood that certain variations including further modifications of the glove will be apparent to those skilled in the art. Accordingly, the invention is to be limited only as set forth hereinafter in the appended claims.

What is claimed is:

1. An ultra lightweight glove for handling a basketball comprising (a) a palm panel layer having lateral edges and a spandex top panel layer having lateral edges; said layers sewn together at lateral edges thereof to provide a glove body construction;

(b) said palm panel layer having an outer surface and an inner surface said the outer surface of said palm panel layer being completely covered by a plurality of protruding rubberized friction elements permanently adhered thereto;

(c) said palm panel layer and said top panel layer being comprised of a spandex material having interstices and being stretchable and comfortable closesly in a skin-tight manner to the anatomy of a hand of a wearer of the glove, said protruding friction elements being bonded in said interstices each of said protruding elements having a shape of a hemisphere extending above said outer surface of said glove, said protruding elements being spaced in a geometric pattern of a plurality of protruding elements and a plurality of valleys between adjacent sets of said plurality of protruding elements, wherein a valley of said plurality of valleys lies between adjacent protruding elements of said plurality of protruding elements, each of said protruding elements having a size and shape substantially equivalent to each of a plurality of hemispherical shaped beaded elements upon an outer surface of the basketball, wherein selected hemispherical beaded elements of the basketball contact selected valleys of said plurality of valleys and selected sets of said plurality of adjacent protruding elements.

2. An ultra lightweight glove for a hand with fingers having fingertips, knuckles and base joints, for handling a round basketball having a plurality of raised protruding hemispherical shaped surface beaded elements extending upward from said basketball surface, comprising:

a thin palm panel layer having top, bottom and lateral side edges;

a top panel layer having top, bottom and lateral side edges;

said palm panel layer and said top panel layer connected together at said respective lateral side edges;

said glove defining a glove body having four finger tubes extending above said base joints of each finger, and further having a partial thumb portion extending above the base of said thumb;

said glove covering at least a raised portion of a palm of said hand below said thumb and a raised portion of said palm below the little finger of said fingers;

said glove having an outer surface of said palm layer being covered by a plurality of raised friction elements permanently adhered thereto, said raised friction elements having a size and hemispheric shape substantially equivalent to said respective raised surface beaded elements of said basketball for intercepting with said respective raised surface beaded elements of said basketball;

said palm layer and said top panel layer being comprised of a stretch fabric material stretching and closely conforming in a skin-type manner to the anatomy of said hand, and to permit close tactile feel of said basketball within said hand;

a basketball gripping and release means to permit said basketball player to randomly and erratically intercept and transiently grasp said basketball, and alternately release said basketball away from said hand, during basketball shooting, dribbling, passing and catching;

said basketball gripping and release means comprising said raised friction elements being located in said thin palm surface layer and said raised friction elements extending from below the proximal first knuckles of said fingers and covering at least a raised area of said palm of said basketball player below said thumb and said little finger, said raised friction elements capable of intercepting said raised surface beaded elements of said basketball to transiently grasp and release said basketball within and from said hands of said basketball player.

* * * * *